United States Patent [19]

Holzgrefe et al.

[11] Patent Number: 5,012,981

[45] Date of Patent: May 7, 1991

[54] INJECTION VALVE

[75] Inventors: Volker Holzgrefe, Ditzingen; Nikolaus Simon, Gerlingen; Ewald Ziegler, Heimsheim, all of Fed. Rep. of Germany

[73] Assignee: Robert Bosch GmbH, Stuttgart, Fed. Rep. of Germany

[21] Appl. No.: 571,002

[22] Filed: Aug. 23, 1990

Related U.S. Application Data

[63] Continuation of Ser. No. 38,073, Apr. 14, 1987, abandoned.

[30] Foreign Application Priority Data

Jul. 19, 1986 [DE] Fed. Rep. of Germany ..... 3624476

[51] Int. Cl.[5] ..... F02M 61/20; F02M 61/10; F02M 61/00

[52] U.S. Cl. ..... 239/533.12; 239/585

[58] Field of Search ..... 239/533.3, 533.12, 585

[56] References Cited

U.S. PATENT DOCUMENTS

| | | | |
|---|---|---|---|
| 2,584,745 | 2/1952 | Seliber | 239/533.4 X |
| 2,743,961 | 5/1956 | L'Orange | 239/596 X |
| 2,769,669 | 11/1956 | L'Orange | 239/533.12 X |
| 3,035,780 | 5/1962 | Peras | 239/533.12 X |
| 4,651,931 | 3/1987 | Hans et al. | 239/533.11 X |

FOREIGN PATENT DOCUMENTS

| | | | |
|---|---|---|---|
| 2543805 | 4/1977 | Fed. Rep. of Germany . | |
| 3418761 | 11/1985 | Fed. Rep. of Germany . | |
| 1005022 | 4/1952 | France | 239/533.4 |

*Primary Examiner*—Andres Kashnikow
*Assistant Examiner*—Lesley D. Morris
*Attorney, Agent, or Firm*—Edwin E. Greigg

[57] ABSTRACT

The invention relates to an injection valve for internal combustion engine fuel injection systems. The valve is designed to inject fuel into the intake manifold. The valve comprises a valve housing containing a core, with which an armature cooperates. A nozzle body with a valve seat is connected to the valve housing. A sealing seat of a valve needle guided in the nozzle body cooperates with the valve seat. The valve needle is guided by first and second guide parts in a guide bore of the nozzle body and the second guide part, which is adjacent to the sealing seat in the upstream direction, is provided with metering bores. These metering bores are inclined such that they produce a spinning effect when the valve is open, thereby providing for good preparation of the fuel. According to the invention, each metering bore discharges immediately proximate to and directly upstream of, the sealing seat.

6 Claims, 1 Drawing Sheet

INJECTION VALVE

This is a continuation of copending application Ser. No. 07/038,073 filed on Apr. 14, 1987, now abandoned.

FIELD OF THE INVENTION

The present invention relates to improvements in fuel injection valves for internal combustion engines.

BACKGROUND OF THE INVENTION

The prior art, German OS 25 43 805 discloses an injection valve wherein an improvement in the discharged fuel jet is obtained by providing spin-producing grooves above the valve seat. These grooves cause the fuel to be spun before it flows through the valve seat. A tangential force component is imparted by these spin grooves to the fuel leaving the ejection opening. Accordingly, the fuel is ejected in the form of a conical spray.

In the injection valve described in German OS 25 43 805, this advantageous spin effect is only partly utilizable. The reason for this is that after leaving the spin grooves incorporated in the periphery of the valve needle the fuel flows into the region of the undercut resulting from the manufacturing process and is markedly decelerated there. As a result, part of the kinetic energy of the fuel stream is converted into other undesirable energy forms, e.g., thermal energy.

A further disadvantage of the latter injection valve just described is that, with this type of valve, metering of the fuel quantity discharged per stroke is determined by the size of the flow cross-section of the ejection opening downstream of the valve seat when the valve is open. What results from this relationship is that the unavoidable deposits which accumulate over time in the ejection opening lead to a reduction in the cross-section of this opening and can thus further result in reduced flow quantities. This phenomenon is referred to as "narrowing down" and is regarded as hazardous to injection system operation. It also occurs with other forms of metering zones when these zones are disposed downstream of the valve seat and thus exposed to the intake manifold atmosphere.

In contrast, the advantage offered by the injection valve disclosed in U.S. Pat. No. 4,651,431 is that of metering the fuel quantity to be ejected upstream of the valve seat. For this purpose, metering bores are provided in a lower guide part of the valve needle. The fuel flows via these openings with an accompanying pressure drop. However, no measures are provided to impart a spin to the fuel. A pintle is provided within the ejection opening to atomize the fuel.

OBJECTS AND ADVANTAGES OF THE INVENTION

The principal object and advantage of the injection valve according to the invention over the prior art is that the formation of deposits in the region of the ejection opening does not influence the fuel metering function of the injection valve, because as metering does not take place in the region of the ejection opening and therefore not in the region of the manifold intake atmosphere which is often exposed to dust particles but rather upstream of the valve seat.

It is a further object of the invention to provide a valve structure in which a marked pressure drop is present at the metering openings thus producing a spinning effect, and therefore the spinning motion can start at a higher speed.

It is still another object of the invention to provide an alternate means of realizing the metering openings producing the spinning motion than by spiral grooves in the region of the valve needle surface as in the prior art. Instead the metering openings extend within the needle such that a mouth of each ejection opening is disposed in the immediate proximity of and upstream of the sealing seat of the injection valve. The advantage of this disposition is that the fuel exiting the spin-producing metering openings is not "decelerated" in the chamber formed by the undercut but flows through the valve seat and ejection opening with high kinetic energy. As a result, more rapid starting of the fuel flow is obtained.

Yet another object and advantage of the invention is that the metering bores according to the invention can he manufactured more easily than the spin grooves disclosed in the prior art.

The invention will be better understood and further objects and advantages thereof will become more apparent from the ensuing detailed description of preferred embodiments taken in conjunction with the drawings.

BRIEF DESCRIPTION OF THE DRAWINGS

The drawings show various embodiments of the invention which will be described in further detail hereinafter.

DESCRIPTION OF THE PREFERRED EMBODIMENT

Figure 1:
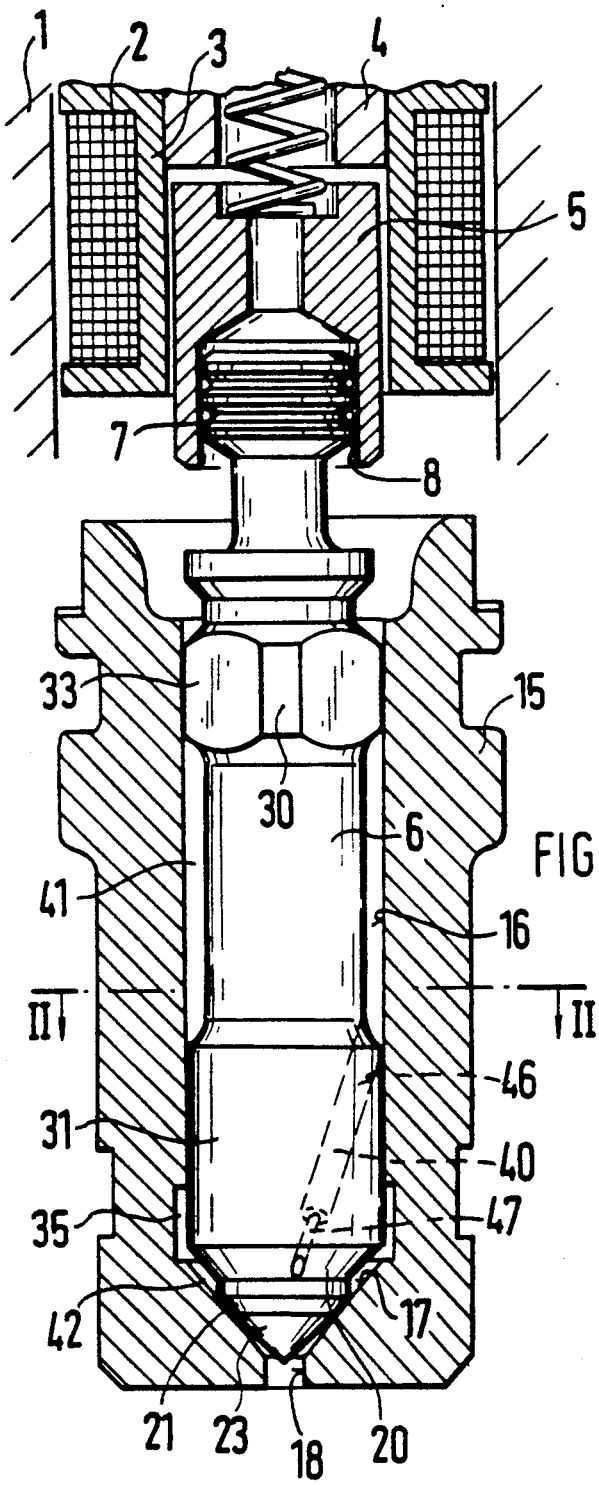
FIG. 1 is a sectional view through a fuel injection valve following the invention.

FIG. 1 shows a magnetic coil 2 mounted on a coil support 3 within a valve housing 1 of a fuel injection valve which is not shown in greater detail. A ferromagnetic core 4 is disposed within the magnetic coil 2 and is partially enclosed by the same. An armature 5 which is also disposed partially within the coil support 3 is disposed opposite the front side of the core 4. The armature 5 is connected to a valve needle 6 which, in turn, fits at one end 7 into a recess 8 provided in the armature 5. The armature 5 is provided with an opening penetrating axially through the same. The valve needle 6 is displaceably mounted in a nozzle body 15 which is connected to the valve housing 1 in a known manner which is not represented. The nozzle body 15 includes a coaxial guide bore 16.

In one extremity of the nozzle body remote from the magnetic coil 2 is disposed a conical valve seat 17 in which a discharge opening 18 is defined. The valve needle 6 is guided in the guide bore 16 of the nozzle body 15 in which the end remote from the magnetic coil 2, terminates in a first conical section 20. A slightly raised narrow sealing seat 21, provided preferably in the form of a truncated cone, is disposed on the nozzle body adjacent to a cylindrical section extending downwardly from the first conical section 20. When the injection valve is closed the sealing seat 21 rests directly on the conical valve seat 17 of the nozzle body 15. To open the injection valve, the valve needle 6 is moved so that the sealing seat 21 is raised from the valve seat 17, thereby producing a flow passage for the fuel. The valve needle 6 includes a second conical section 23 an its terminal end adjacent to the sealing seat 21. Thus, the sealing seat is disposed between the first and second conical sections. The second conical section 23 can be defined as a cone, as shown, or it may be provided with a pintle which, forming a coaxial extension of the valve needle 6, projects into the discharge opening 18 of the nozzle body 15.

The valve needle 6 comprises two guide parts 30 and 31 which are spaced axially apart with respect to one another and spaced from each other by a reduced diameter portion. These parts 30 and 31 guide the valve needle 6 within the guide bore 16. The first guide part 30, which is disposed upstream, may be provided on its periphery with flow openings, for example, square relieved areas 33 which allow for exchange of the liquid disposed in the space between the two guide parts 30,31. Adjacent to the first conical section and a portion of the guide part 31, the guide bore 16 of the nozzle body 15 is provided with a radially disposed enlargement 35. This enlargement is necessited by the manufacturing process. The diameter of the enlargement 35, which can also be referred to as an "undercut", is larger than the diameter of the guide bore 16. The conical valve seat 17 has a wall which diverges from the discharge opening to terminate adjacent to the enlargement 35. In contrast to the first guide part 30, the second guide part 31 of the valve needle 6, which is guided in the guide bore 16 and which may be partially enclosed by the enlargement 35, must be cylindrical in shape.

The second guide section 31 is penetrated by at least one passage 40. The passage 40 connects an inner chamber 41 defined between the guide bore and the reduced diameter portion of the valve needle guide parts 30, 31 with a spin chamber 42 defined by the enlargement 35, the conical valve seat 17 of the nozzle body and by a portion of the second guide part 31 and the first conical part 20 of the valve needle 6. The inner chamber 41 and the spin chamber 42 are thus separated from one another by the second guide part 31. The passage 40 is incorporated in such a way that, at its discharge end, it opens onto the surface of the first conical section 20 of the valve needle 6. The end of passage 40 is preferably situated immediately proximate to the cylindrical portion between the first conical section 20 and raised sealing seat 21.

The passage 40 can be manufactured cost effectively if, as shown in the drawing, the passage 40 comprises two bores of different diameter: a larger diameter blind bore 46 which, on the one hand, communicates with the inner chamber 41 and penetrates the second guide part 31, and a smaller diameter metering bore 47 joins the blind bore 46 from a point beginning at the foot of the blind bore 46 and extends in axial alignment therewith terminating so as to discharge into the spin chamber 42. The mouth of the metering bore 47 leading into the spin chamber 42 is preferably immediately proximate to the reduced diameter portion between the first conical section and the slightly raised sealing seat 21.

Figure 2:
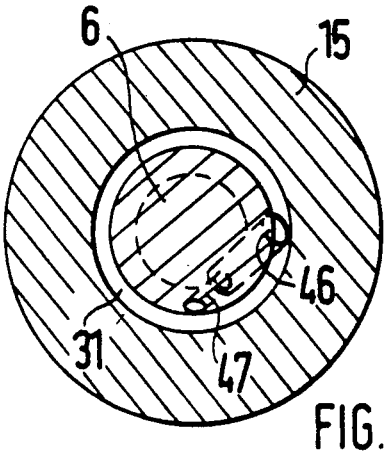
FIG. 2 is a cross-sectional view along the line II—II in FIG. 1.

To produce a spin in the fuel being ejected, the longitudinal axis of the blind bore 46 and the metering bore 47 must provide both an axial and a tangential component to the fuel flow. As best shown in FIG. 2, this orientation is achieved in the case of the injection valve according to the invention in that, when viewed in an axial direction of the injection valve, the mouth of the blind bore 46 leading into the inner chamber 41 must be radially offset by a specific angle with respect to the mouth of the metering bore 47 into the spin chamber 42. This angle is preferably between 60 and 120 degrees. If the angle is 0 or 180 degrees, the tangential component is zero and the fuel leaves the valve needle 6 without any spin. As a result of the fact that the metering bore 47 discharges immediately proximate to the sealing seat 21, the fuel leaving the metering bore 47 passes directly into the spin chamber 42 and is there set in rotation to "spin" along the valve seat 17 to the discharge opening 18. It is important that the metering bore 47 be oriented such that the fuel jet leaving the same flows onto the conical valve seat 17 and not onto the inner wall defining the enlargement 35. The blind bore 46 and the metering bore 47 need not be aligned in axial alignment with one another; rather they can extend at a specific angle with respect to one another.

Figure 3:
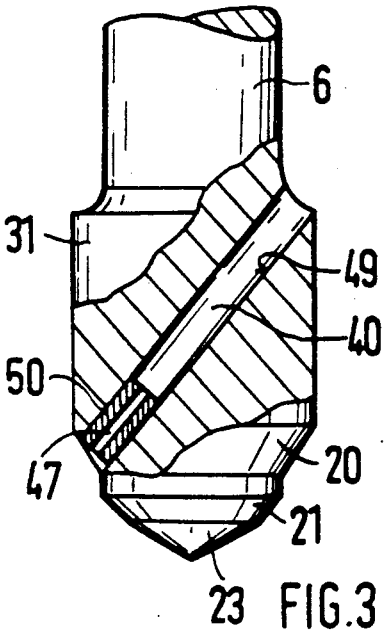
FIG. 3 shows a detailed sectional view of part of the valve needle shown in FIG. 1 in another embodiment.

In still another embodiment of the invention, which is partially shown in cutaway form in FIG. 3, it is also possible for the pocket bore 46 to be replaced by a through bore 49 provided in the same diameter throughout the valve needle, entry to exit, and for a cylindrical insert 50 comprising the metering bore 47 to be secured in a lower extremity of this through bore 49 such that this insert 50 is disposed in the downstream part of the passage 40 to meter fuel prior to its exit onto the valve seat 17. The advantage of this embodiment is that the valve needle of the invention can be used for other applications by merely changing the insert 50 and not the entire valve needle 6.

For reasons of clarity the drawings only show one passage 40, one blind bore 46 and one metering bore 47. However, to ensure a good ejection performance of the injection valve it may he advisable to provide several of these characteristics, for example, four passages 40 which are radially offset with respect to one another by an angle of 90 degrees.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An injection valve for internal combustion engine fuel injection systems comprising a nozzle body having a guide bore therein for receiving a valve needle, said nozzle body provided with a conical valve seat at an innermost end of said bore and with an adjacent discharge opening, said valve needle being provided with a conical section, a sealing seat arranged to cooperate with the valve seat to control flow of fuel from said injection valve, said valve needle being further provided upstream of said valve seat with at least one peripheral guide portion adapted to guide a valve needle in said guide bore, said at least one guide portion being provided with at least one passage extending from an upper extremity thereof through said valve needle to exit in a lower extremity of the guide portion, a fuel chamber (42) between said lower extremity of said guide portion and said sealing seat, said passage including a larger diameter bore and a smaller concentric metering bore joining said larger diameter bore downstream thereof adapted to define a jet of discharge fuel into said fuel chamber between said lower extremity of said guide portion and said sealing seat, said smaller diameter metering bore being provided with an outlet penetrating said valve needle directly opposite said conical valve seat, thereby directing said jet of discharge fuel onto said conical valve seat, said smaller diameter metering bore being adapted to impart a spinning motion to said jet of discharge fuel.

2. An injection valve as claimed in claim 1, further wherein said outlet of the metering bore is disposed in said conical section of the valve needle and said conical section is disposed upstream of the sealing seat.

3. An injection valve for internal combustion engine fuel injection systems comprising a nozzle body having a guide bore therein for receiving a valve needle, said nozzle body provided with a conical valve seat at an innermost end of said bore and with an adjacent discharge opening, said valve needle being provided with a conical section, a sealing seat arranged to cooperate with the valve seat to control flow of fuel from said conical section, said valve needle being further provided upstream of said valve seat with at least one peripheral guide portion adapted to guide the valve needle in said guide bore, said at least one guide portion being provided with at least one passage extending from an upper extremity thereof through said valve needle to exit in a lower extremity thereof through said needle to exit in a lower extremity of the guide portion, a fuel chamber (42) between said lower extremity of said guide portion and said sealing seat, said passage including a larger diameter bore and a smaller concentric diameter metering bore joining said larger diameter bore downstream thereof in axial alignment therewith and adapted to define a jet of discharge fuel into said fuel chamber between said lower extremity of said guide portion and said sealing seat, said smaller diameter metering bore being provided with an outlet penetrating said valve needle directly opposite said conical valve seat, thereby directing said jet of discharge fuel onto said conical valve seat, said smaller diameter metering bore being adapted to impart a spinning notion to said jet of discharge fuel.

4. An injection valve as claimed in claim 3, further wherein said outlet of the metering bore is disposed in said conical section of the valve needle and said conical section is disposed upstream of the sealing seat.

5. An injection valve for internal combustion engine fuel injection systems comprising a nozzle body having a guide bore therein for receiving a valve needle, said nozzle body being provided with a conical valve seat at an innermost end of said bore and with an adjacent discharge opening, said valve needle being provided with a conical section, a sealing seat arranged to cooperate with the valve seat to control flow of fuel from said injection valve, said valve needle being further provided upstream of said valve seat with at least one peripheral guide portion adapted to guide the valve needle in said guide bore, said at least one guide portion being provided with at least one passage extending from an upper extremity thereof through said valve needle to exit in a lower extremity of the guide portion, a fuel chamber (42) between said lower extremity of said guide portion and said sealing seat, said passage having a constant diameter over its length, an elongated, cylindrical insert disposed in a lower, downstream portion of said passage, said insert including a concentric metering bore of smaller diameter adapted to define a jet of discharge fuel to said fuel chamber between said lower extremity of said guide portion and said sealing seat, said metering bore being provided with an outlet penetrating said valve needle directly opposite said conical valve seat, thereby directing said jet of discharge fuel onto said conical valve seat, said metering bore being adapted to impart a spinning notion to said jet of discharge fuel.

6. An injection valve as claimed in claim 5, further wherein said outlet of the metering bore is disposed in said conical section of the valve needle and said conical section is disposed upstream of the sealing seat.

* * * * *